US006047670A

United States Patent [19]

Stella et al.

[11] Patent Number: 6,047,670

[45] Date of Patent: Apr. 11, 2000

[54] PURIFIER DEVICE FOR A BLEED CIRCUIT OF AN ENDOTHERMAL ENGINE BLOCK AND A BLEED CIRCUIT PROVIDED WITH THIS DEVICE

[75] Inventors: Angelo Stella, Rosate; Franco Rossi, Milan; Giancarlo Dellora, Settimo Torinese, all of Italy

[73] Assignees: Pall Corporation, East Hills, N.Y.; Iveco Fiat S.p.A., Turin, Italy

[21] Appl. No.: 08/864,643

[22] Filed: May 29, 1997

[30] Foreign Application Priority Data

May 31, 1996 [IT] Italy ..... TO096A0473

[51] Int. Cl.[7] ..... F01M 13/00

[52] U.S. Cl. ..... 123/41.86; 123/572

[58] Field of Search ..... 123/41.86, 572, 123/573; 210/799, DIG. 5

[56] References Cited

U.S. PATENT DOCUMENTS

| | | | |
|---|---|---|---|
| 3,326,198 | 6/1967 | Jackson et al. | 123/572 |
| 4,632,682 | 12/1986 | Erdmannsdörfer | 55/498 |
| 4,920,930 | 5/1990 | Sakano et al. | 123/41.86 |
| 5,429,101 | 7/1995 | Uebelhoer et al. | 123/572 |
| 5,507,307 | 4/1996 | Montegari et al. | 137/9 |
| 5,512,175 | 4/1996 | Saito et al. | 210/299 |
| 5,697,349 | 12/1997 | Blum | 123/572 |

*Primary Examiner*—Noah P. Kamen
*Assistant Examiner*—Hai Huynh
*Attorney, Agent, or Firm*—Kane, Dalsimer, Sullivan and Levy, LLP

[57] ABSTRACT

A purifier device for a bleed circuit of a block of an internal combustion engine provided with a filter member acting by coalescence adapted to be traversed by a flow of gases from the interior of the block and containing oil and particulates in suspension; the filter member has an absolute retaining power such as to allow the passage of the particulates so that they are incorporated on the particles of oil agglomerated by coalescence within the filter member and are removed with this oil without the risk of the filter member becoming clogged up.

15 Claims, 1 Drawing Sheet

PURIFIER DEVICE FOR A BLEED CIRCUIT OF AN ENDOTHERMAL ENGINE BLOCK AND A BLEED CIRCUIT PROVIDED WITH THIS DEVICE

BACKGROUND OF THE INVENTION

The present invention relates to a purifier device for a bleed circuit of the block of an endothermal engine.

As is known, the blocks of endothermal engines are provided with a bleed circuit adapted to discharge outside this block the so-called "blow-by" gases, i.e. gases that are drawn down by the cylinders into the block via the piston segments. The bleed is necessary both to prevent an increase of pressure within the block and to offset the volume variations due to the movement of the pistons.

The blow-by gases contain finely atomised oil particles as well as particles of non-combusted carbon materials (particulates) having dimensions of the order of some $\mu$m, typically between 5 and 8 $\mu$m.

The bleed circuit is in this case of the open type, i.e. it discharges the blow-by gases into the atmosphere; in this case the oil and the particulates have to be separated from the gases for obvious reasons of environmental and health protection (the particulates have a carcinogenic effect).

More frequently, and also for regulatory reasons, the bleed circuit is of the closed type and recirculates the blow-by gases to the engine intake in order to ensure the complete combustion of the particulates. In this case as well, however, the separation of the oil and the particulates raises a problem; the oil and the particulates tend to form resinous sediments on the components through which the gases pass before reaching the cylinders (in particular on the valves and, in the case of turbocharged engines, in the compressor and the intercooler where they greatly reduce the heat exchange), compromising the correct operation of these components. Moreover, in vehicles fitted with catalytic converters, the combustion of any engine oil recirculated to the intake has damaging effects on the catalytic converter and on the lambda probe.

While purifier devices of various types have therefore been proposed, they all have drawbacks.

For instance, impact separators are known in which the flow of gas interacts with walls which cause rapid changes of direction of this flow; separators of this type are not, however, very efficient as regards the separation of the particulates, since the average dimensions of the particulates are too small, and are very bulky. The use of filter members of a conventional type has also proved to be unsatisfactory as, while they have a retaining power sufficient to separate out the particulates, the loss of load through the members themselves is in all likelihood undesirably high and, moreover, the members clog up rapidly.

SUMMARY OF THE INVENTION

The object of the present invention is to provide a purifier device for a bleed circuit of an endothermal engine block which is free from the drawbacks connected with the known purifier devices described above.

This object is achieved by the present invention which relates to a bleed circuit for an endothermal engine block for the discharge of gases containing oil and particulates in suspension, this circuit comprising a purifier device having an inlet connected with the interior of the block, an outlet and a filter member interposed between this inlet and outlet and adapted to be traversed by the gases in a given direction of flow, characterised in that this filter member is a coalescence filter adapted to cause the oil to coalesce.

The present invention also relates to a purifier device for a bleed circuit of an endothermal engine block comprising an inlet adapted to be connected with the interior of the block and to receive gases containing oil and particulates in suspension, an outlet and a filter member disposed between this inlet and outlet and adapted to be traversed by the gases in a given direction of flow, characterised in that the filter member is a coalescence filter adapted to cause the oil to coalesce.

BRIEF DESCRIPTION OF THE DRAWINGS

For a better understanding of the present invention, a preferred embodiment is described below by way of non-limiting example with reference to the accompanying drawings, in which.

DETAILED DESCRIPTION OF THE INVENTION

Figure 1:
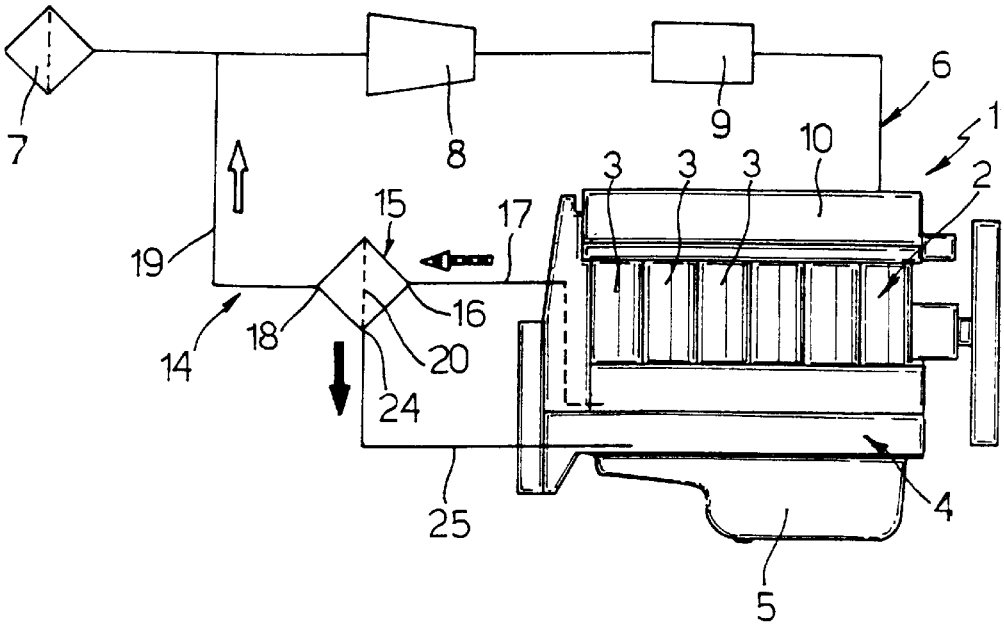
FIG. 1 is a diagram illustrating an endothermal engine whose block is provided with a bleed circuit incorporating a purifier device in accordance with the present invention.

In FIG. 1, an endothermal engine comprising a head 2 defining a plurality of cylinders 3, a block 4 and a container 5 adapted to contain lubricating oil is shown by 1. The engine 1 comprises an intake circuit 6 comprising, in series with one another, an inlet filter 7 of conventional type, a turbocharge compressor 8 coupled to a turbine (not shown), an intercooler 9 and an intake manifold 10. The circuit 6 is not described in further detail as it is known.

The block 4 of the engine 1 is also provided with a bleed circuit 14 for the external discharge from this block of the so-called "blow-by" gases, i.e. the gases that are drawn down between the cylinders and the relative pistons (not shown).

These gases contain particles of finely atomised oil in suspension as well as solid particles (particulates) predominantly of a carbonaceous nature which are formed in part by partially non-combusted combustion products and in part by solid impurities normally contained in the oil. The dimensions of the particulates are typically between 5 and 8 $\mu$m.

The bleed circuit 14 is preferably of the closed type and connects the interior of the block 4 to the intake circuit 6 downstream of the inlet filter 7.

The bleed circuit 14 comprises a purifier device 15 having an inlet 16 connected by a duct 17 to the block 4 and an outlet 18 connected by a duct 19 to the intake circuit 6.

According to the present invention, the purifier device 15 comprises a filter member 20 of the coalescence type interposed between the inlet 16 and the outlet 18.

The filter member 20 is of the type adapted to cause the finely atomised oil particles to agglomerate by coalescence and to remove (but not to filter) the solid particles.

A filter appropriate for this purpose is formed by a fibrous mass of non-woven synthetic polymer micro-fibres. The fibres are substantially free from fibre-fibre bonds and are mechanically linked to one another by entanglement or interlacing. The fibrous mass has a substantially constant volume of spaces.

The fibrous mass is formed by upstream and downstream portions 20*a*, 20*c*, formed by fibres whose diameter is greater than that of the fibres forming a central portion 20*b* between the upstream and the downstream portions. The effect of this arrangement is to produce relatively coarse drainage layers upstream and downstream with an intermediate layer having an absolute retaining power. The absolute retaining power may be between 5 and 70 μm, preferably between 8 and 30 μm and in particular 20 μm. The retaining power is selected such that the particulates are not retained in the fibrous mass.

It will be appreciated that the fibrous mass may have any convenient structure. Various possibilities are illustrated in GB-A-2 247 849. One possibility is to have the portion with an absolute retaining power forming the upstream surface of the filter and only one coarse layer forming the downstream surface. It would also be possible to vary the structure of the fibrous mass continuously through the thickness of the fibrous mass from a layer with an absolute retaining power at the upstream surface to a coarse layer at the downstream surface.

Fibrous masses with these structures form a deep filter means with a high resistance to soiling.

An example of this filter means is marketed by the Pall Corporation under the trade name "PROFILE STAR".

Figure 2:
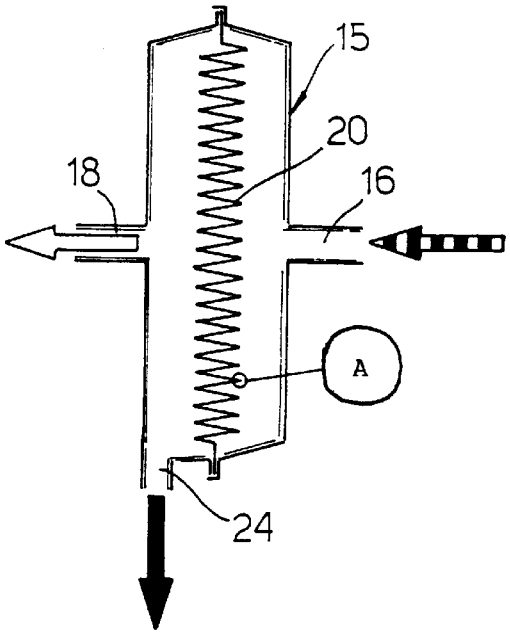
FIG. 2 is a diagrammatic section on an enlarged scale of the purifier device of FIG. 1, with one detail further enlarged.
Figure 2A:
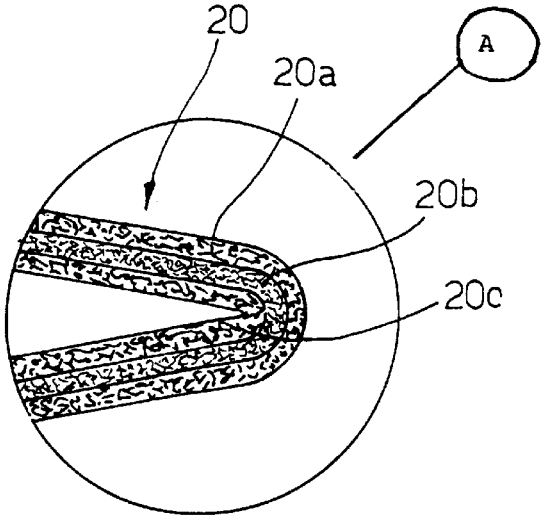

The fibrous mass may be shaped in various ways. For instance, it may be in the form of a pleated cylinder without a lateral seal. As shown in FIG. 2, however, the fibrous mass may alternatively be formed as a pleated sheet.

The purifier device 15 has a drainage outlet 24 disposed downstream of the filter member 20 and connected to a lower zone of the block 4 by a duct 25.

The operation of the bleed circuit 14 and, in particular, the purifier device 15 is as follows.

The blow-by gases with the oil and particulates in suspension (shown by a black and white arrow) flow through the duct 17 into the purifier device 15. The particles of oil pass into the filter member 20 where they agglomerate by coalescence to form droplets of dimensions sufficient to prevent them from being drawn downstream; the oil therefore drips onto the base of the filter member 20 and is recirculated into the lower zone of the block 4 via the drainage outlet 24 and the duct 25 and then drips into the container 5.

The oil in suspension may typically enter the purifier device at a rate of some 2–3 g/hour. In a particular experimental configuration of the type described above, the purifier device 15 was fitted with a filter member 20 in the form of a pleated sheet of filter medium having a sheet surface area of 0.1 $m^2$. In this configuration, an inlet flow of oil into the purifier device 15 of 2 g/hour was observed and the oil flow through the outlet was 0.3 g/hour. In other words, the purifier device removed some 85% of the oil from the blow-by gases—the oil removed then being recirculated into the block 4 via the drainage outlet 24.

The particulates which would tend, in the absence of oil, to pass through the filter member 20 as mentioned above, are incorporated on the droplets of oil that agglomerate by coalescence in this member and are recirculated into the block together with the oil. The flow of oil and particulates is shown by a black arrow in the Figures.

The gases stripped of the oil and particulates (white arrow) flow through the outlet 18 of the purifier device 15 and the duct 19 and are recirculated into the intake circuit 6.

The advantages that can be obtained with the present invention are evident from an examination of the characteristic features of the bleed circuit 14 and, in particular, the purifier device 15 embodied in accordance with the present invention.

The use of a filter member of coalescent type makes it possible to separate the oil and particulates from the flow of blow-by gases in an efficient way, with particularly small losses of load and very reduced bulk and cost. Moreover, the use of a filter member with an absolute retaining power that allows the passage of the particulates makes it possible to avoid the clogging up of the filter as the particulates do not accumulate in the filter but are removed by the oil.

It is lastly evident that modifications and variants that do not depart from the scope of the claims may be made to the bleed circuit 14 and the purifier device 15. The circuit 14 may, for instance, be of the open type and communicate with the outside atmosphere. Moreover, the geometry of the filter member 20 may be of any type, for instance a cylindrical cartridge with a radial flow.

We claim:

1. A bleed circuit (14) for a block (4) of an endothermal engine (1) for the discharge of gases containing oil and particulates in suspension, this circuit (14) comprising a purifier device (15) having an inlet (16) adapted to be connected with the interior of the block (4), an outlet (18) and a filter member (20) interposed between this inlet (16) and outlet (18) and adapted to be traversed by the gases in a given direction of flow, characterised in that this filter member (20) is a coalescence filter adapted to cause the oil to coalesce, and the filter member (20) having an absolute retaining power of between 8 and 30 μm such that the particulates can pass through the filter member (20).

2. A circuit as claimed in claim 1, characterised in that the filter member (20) has an absolute retaining power of 20 μm.

3. A circuit as claimed in claim 1, characterised in that the filter member (20) has this absolute retaining power at an upstream surface of the filter member.

4. A circuit as claimed in claim 1, characterised in that the filter member (20) has this absolute retaining power in a central filtration layer with relatively coarser associated drainage layers upstream and downstream.

5. A circuit as claimed in claim 1, characterised in that it comprises means (19) for connecting the outlet of the filter member (20) to an intake circuit (6) of the engine (1).

6. A circuit as claimed in claim 1, characterised in that the filter member (20) is such that the coalescing oil traps the particulates on the oil that has agglomerated by coalescence in order to remove these particulates.

7. A circuit as claimed in claim 1, characterised in that the filter member (20) is formed by a fibrous mass of non-woven synthetic polymer micro-fibres substantially free from fibre-fibre bonds and mechanically linked to one another by entanglement or interlacing.

8. A circuit as claimed in claim 1, characterised in that the purifier device (15) is adapted to remove at least 85% of the oil from the gases.

9. A purifier device (15) for a bleed circuit (14) of a block (4) of an endothermal engine (1) comprising an inlet (16) adapted to be connected with the interior of this block (4) and to receive gases containing oil and particulates in suspension, an outlet (18) and a filter member (20) interposed between this inlet (16) and outlet (18) and adapted to be traversed by the gases in a given direction of flow, characterised in that this filter member (20) is a coalescence filter adapted to cause the oil to coalesce, and the filter member (20) having an absolute retaining power such that the particulates can pass through the filter member (20).

10. A device as claimed in claim 9, characterised in that the filter member (20) has an absolute retaining power of 20 μm.

11. A device as claimed in claim 9, characterised in that the filter member (20) has this absolute retaining power in a central filtration layer with relatively coarser associated drainage layers upstream and downstream.

12. A device as claimed in claim 9, characterised in that the filter member (20) has this absolute retaining power at an upstream surface of the filter member (20).

13. A device as claimed in claim 9, characterised in that the filter member (20) is such that the coalescing oil traps the particulates on the oil that has agglomerated by coalescence in order to remove these particulates.

14. A circuit as claimed in claim 9, characterised in that the filter member (20) is formed by a fibrous mass of non-woven synthetic polymer micro-fibres substantially free from fibre-fibre bonds and mechanically linked to one another by entanglement or interlacing.

15. A circuit as claimed in claim 9, characterised in that the purifier device (15) is adapted to remove at least 85% of the oil from the gases.

* * * * *

UNITED STATES PATENT AND TRADEMARK OFFICE

CERTIFICATE OF CORRECTION

PATENT NO. : 6,047,670

DATED : April 11, 2000

INVENTOR(S) : Angelo Stella, Franco Rossi, Giancarlo Dellora

It is certified that error appears in the above-identified patent and that said Letters Patent are hereby corrected as shown below:

On the title page under heading [30] Foreign Application Priority Data, the number of the priority document should be changed from "TO096A473" to --TO96A0473--.

Signed and Sealed this

First Day of May, 2001

*Attest:*

Nicholas P. Godici

NICHOLAS P. GODICI

*Attesting Officer*

*Acting Director of the United States Patent and Trademark Office*